US006370803B1

(12) United States Patent
Burquest

(10) Patent No.: US 6,370,803 B1
(45) Date of Patent: Apr. 16, 2002

(54) BANNER STAND HAVING SWIVEL CONNECTOR AND METHODS

(75) Inventor: Bradley L. Burquest, Eden Prairie, MN (US)

(73) Assignee: VisionQuest Display, Eden Prairie, MN (US)

( * ) Notice: Subject to any disclaimer, the term of this patent is extended or adjusted under 35 U.S.C. 154(b) by 0 days.

(21) Appl. No.: 09/454,559

(22) Filed: Dec. 7, 1999

(51) Int. Cl.[7] ..... G09F 15/00; G09F 21/00
(52) U.S. Cl. ..... 40/606; 40/741; 52/645
(58) Field of Search ..... 40/603, 604, 606, 40/610, 743, 783, 784, 741, 742; 403/164, 165; 52/645, 646

(56) References Cited

U.S. PATENT DOCUMENTS

| | | | | |
|---|---|---|---|---|
| 381,342 A | | 4/1888 | De Land | |
| 1,003,355 A | | 9/1911 | Green | |
| 1,080,317 A | | 12/1913 | Beckwith | |
| 1,093,119 A | | 4/1914 | Donavan | |
| 1,700,637 A | | 1/1929 | Lamb | |
| 2,012,385 A | | 8/1935 | Gearing | |
| 2,573,156 A | | 10/1951 | Meyer | |
| 2,748,955 A | | 6/1956 | Anselmo | |
| 2,982,379 A | | 5/1961 | Fisher | |
| 3,494,405 A | | 2/1970 | Sandahl et al. | |
| 4,063,833 A | | 12/1977 | Strong | |
| 4,325,197 A | * | 4/1982 | Achten et al. | 40/610 |
| 4,398,840 A | * | 8/1983 | French | 403/98 |
| 4,408,407 A | | 10/1983 | Bloom et al. | |
| 4,533,122 A | | 8/1985 | Bannister | |
| 4,606,394 A | | 8/1986 | Bannister | |
| 4,642,946 A | | 2/1987 | Koch | |
| 4,784,205 A | | 11/1988 | Johnson et al. | |
| 4,817,319 A | | 4/1989 | Vitale | |
| 5,217,315 A | | 6/1993 | Rosane | |
| 5,286,130 A | * | 2/1994 | Mueller | 403/165 X |
| 5,393,162 A | | 2/1995 | Nissen | |
| 5,483,779 A | * | 1/1996 | Crawford et al. | 40/610 X |
| 5,621,994 A | * | 4/1997 | Cobb et al. | 40/605 X |
| 6,161,320 A | * | 12/2000 | Peterson | 40/603 X |

FOREIGN PATENT DOCUMENTS

FR 334400 10/1903

OTHER PUBLICATIONS

Brochure entitled "The only versatile, over–the–shoulder portable exhibit system", *Display One,* Kalamazo, MI, 1 page.
Brochure entitled "Tube Fabrication", *JTD Enterprises Incorporated,* Troy, MI, 1 page.
Brochure exhibiting systems and a price list, *Testrite Instrument Co., Inc.,* Newark, NJ, 4 pages.

* cited by examiner

*Primary Examiner*—Brian K. Green
(74) *Attorney, Agent, or Firm*—Merchant & Gould P.C.

(57) ABSTRACT

A banner stand for displaying an advertising sign, the banner stand being adjustable to multiple shapes and sizes. A four-sided, rectangular stand frame has at least two telescoping members so as to provide the stand with various sizes. A swivel connector is positioned at an end of each telescoping member so as to compensate for any misalignment produced by the telescoping feature of the members.

18 Claims, 4 Drawing Sheets

BANNER STAND HAVING SWIVEL CONNECTOR AND METHODS

FIELD

This disclosure relates to a banner stand, and methods for assembling a banner stand, and methods for displaying a banner. In particular, a swivelable connector for use in a banner stand.

BACKGROUND

In the business world, the conveyance of information, particularly the dissemination of advertisements and other product and company information, is necessary to attract customers. Without an influx of new customers, many business may not able to remain in business. To more efficiently disseminate information about their products, many manufacturing and service businesses display their wares at trade shows, conventions, open houses, and the like.

Businesses typically set up temporary displays to advertise or show their products and services at conventions and trade shows. Depending on the company and the product being advertised, the displays vary greatly in set-up, size and shape, and type of display. A typical display at a trade show or convention includes tables, counters, or display shelves on which product samples and literature are displayed. A backwall display is commonly used to display information. A typical backwall display is a structure with a generally three dimensional aspect; that is, the wall has some thickness to it, often about 3 feet. Backwall displays are portable, and often break down to fit into a trunk having dimensions of about 2 feet by 2 feet by 3 feet. An alternative sign used in the display area is a "banner" or a "banner stand". A banner display generally includes a metal, plastic, or wood two-dimensional frame (i.e., a "banner frame") supporting a cloth or paper advertising sign (i.e., a "banner"). Together, they form a banner stand.

Because the various displays at trade shows and conventions are only temporary, it is preferable that the signs used are light weight and portable. Preferably, the signs break down into compact articles that are easy to transport. There have been many designs of free-standing signs that can collapse and/or can disassemble, but a large sign, with either long frame members or multiple segments for each frame member, can be large and bulky when disassembled. What is desired is a sign that, when not being used as a display, can be easily disassembled into a small, compact, and transportable unit.

Further, because the space allocated to a display will vary from one trade show or convention to another, businesses need to vary their displays, including their banners and signs, to fit the allotted space. To decrease costs associated with having multiple sizes stands, it would be preferable if the same frame could be used for various sized banners or signs. Frames and stands have been designed that are expandable to multiple sizes and shapes. However, the sizes available typically have been limited by the physical characteristics of the frame members; some frames are expandable only by preset increments. What is desired is a banner frame that is compact and that can be used with various sizes of banners.

SUMMARY OF THE DISCLOSURE

The present disclosure provides a banner stand that includes a frame for supporting an advertisement sign. In one embodiment, the frame comprises a pair of first members and a pair of second members; each first member has a first end and a second end and is telescoping, and each second member has a first end and a second end. At least two swivel connectors are configured for connecting the pair of first members with the pair of second members. The swivel connectors are attached to the first end of each of the pair of first members, for example, by a threaded pin or screw, and each swivel connector is further removably attached to one of the pair of second members. The swivel connectors each has a male portion and a female portion. The male portion has a body, preferably a cylindrical body, with a groove therein and a base. The female portion also has a body, preferably a cylindrical body, and a base. The base of the female portion has a recess that is constructed and arranged to accept at least a portion of the male portion therein. This allows rotation of the male portion in relation to the female portion along a longitudinal axis.

The frame provides a self-standing support that is expandable for displaying various sizes of advertisement signs. Methods of assembling the frame and displaying a sign are also disclosed.

DETAILED DESCRIPTION OF THE PREFERRED EMBODIMENT

Figure 1:
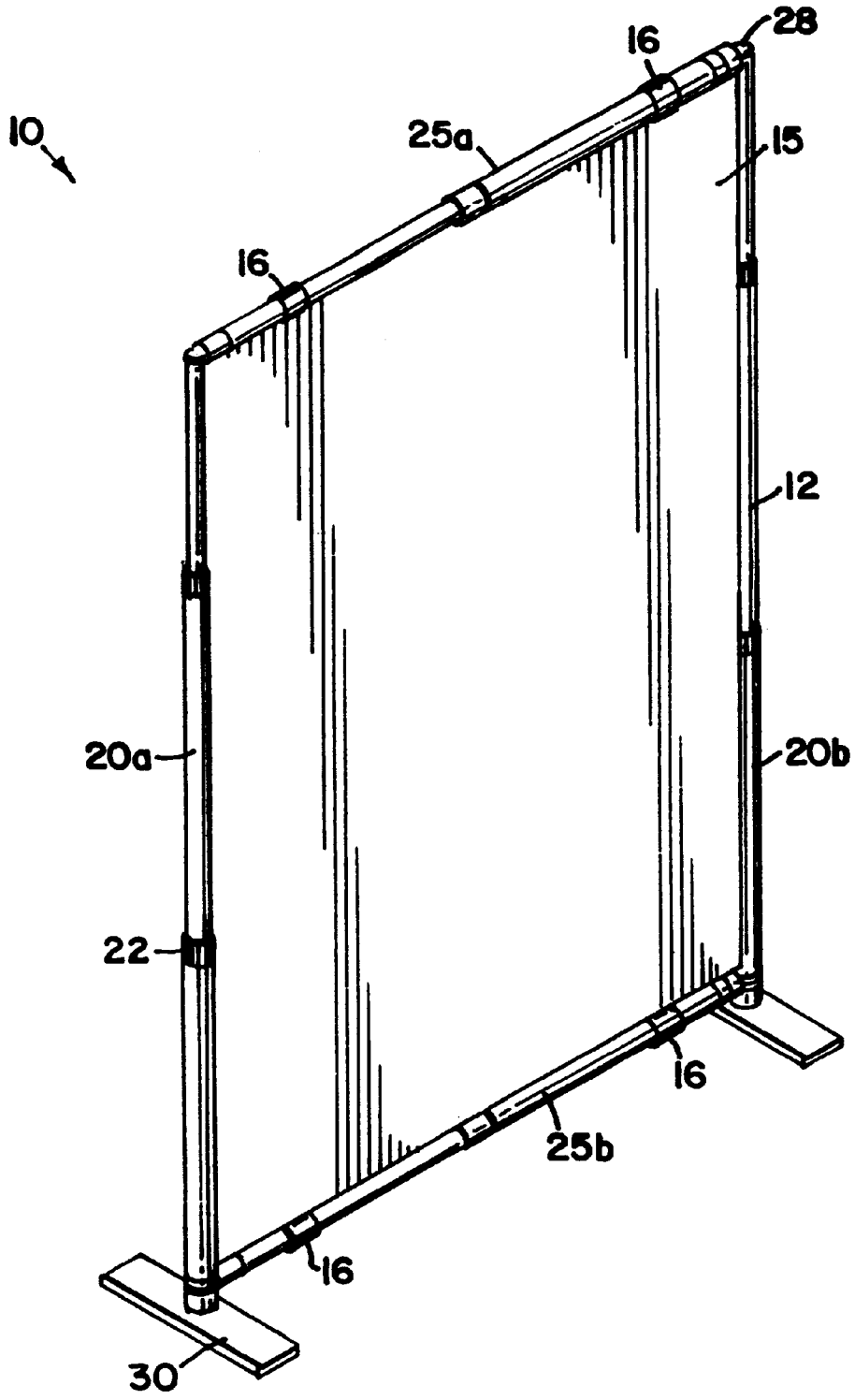
FIG. 1 is a perspective view of a banner stand, including a banner mounted on a frame, according to the present disclosure.

FIG. 1 shows a perspective view of a banner stand 10 that includes a frame portion 12 and advertisement sign 15. Frame portion 12 includes vertical members 20 and horizontal members 25, which are joined at comers 28. "Vertical members" refers to members that are perpendicular, or close to perpendicular, to the ground or other supporting surface on which banner stand 10 is positioned; usually, vertical members are positioned at an angle of about 60 to 120 degrees, preferably 90 degrees, from the supporting surface. Vertical members extend away from the ground and provide the height of banner stand 10. "Horizontal members" refers to members that are parallel, or close to parallel, to the ground or other supporting surface on which banner stand 10 is positioned; horizontal members are positioned at an angle of less than about 30 degrees, preferably about 0 degrees (i.e., parallel) to the supporting surface. Horizontal members provide the width of banner stand 10. Vertical members 20 and horizontal members 25 form an angle of about 80–100 degree therebetween, typically about 90 degrees.

Frame portion 12 supports advertisement sign 15 and allows advertisement sign 15 to be displayed. Advertisement sign 15 may be mounted on frame 12 by loops 16, such as shown in FIG. 1; such loops 16 may be permanent (e.g., glued or stitched) or may be openable (e.g., snapped or secured by a hook and loop attachment system). Multiple loops 16 or one long loop or sleeve may be used. To stabilize frame portion 12 and any sign 15, banner stand 10 includes base members 30, which provide support and stability for banner stand 10.

As mentioned above, frame 12 includes vertical members 20 and horizontal members 25. Each end of vertical members 20 is joined with a horizontal member 25 in order to form a four sided frame, preferably a rectangular or square frame. Horizontal members 25 (both the top horizontal member 25*a* and the bottom horizontal member 25*b*) are joined to vertical members 20 at four comers 28 by connectors, either non-swivel connectors 40 or swivel connectors 50, which will be described in detail below. Preferably, the non-swivel connectors 40 and swivel connectors 50 are disposed on the ends of horizontal members 25. Each horizontal member 25 has at least one swivel connector 50, but may have two swivel connectors 50, one at each end of member 25. The connectors, either 40 or 50, are constructed and arranged to provide attachment of horizontal members 25 with vertical members 20. In some embodiments, the connectors 40, 50 may be disposed on vertical members 20 to provide attachment of vertical members 20 to horizontal members 25.

Connectors 40, 50 are disposed on the ends of the members, typically the horizontal members 25, by threaded connections. In one example, a swivel connector 50 is disposed on a first end of horizontal member 25 and a non-swivel connector 40 is disposed on a second end, opposite the first end, of horizontal member 25. Both connectors 40, 50 may be disposed on horizontal member 25 by way of an externally threaded screw that extends from connector 40, 50 and that mates and connects with internal threads within the ends of horizontal member 25. See, for example, connector 50 in FIG. 3 and connectors 40 and 50 in FIG. 4. Alternately, an externally threaded pin may be within an end of horizontal member 25, and a connector 40, 50 may be internally threaded to accept the externally threaded pin.

Figure 2:
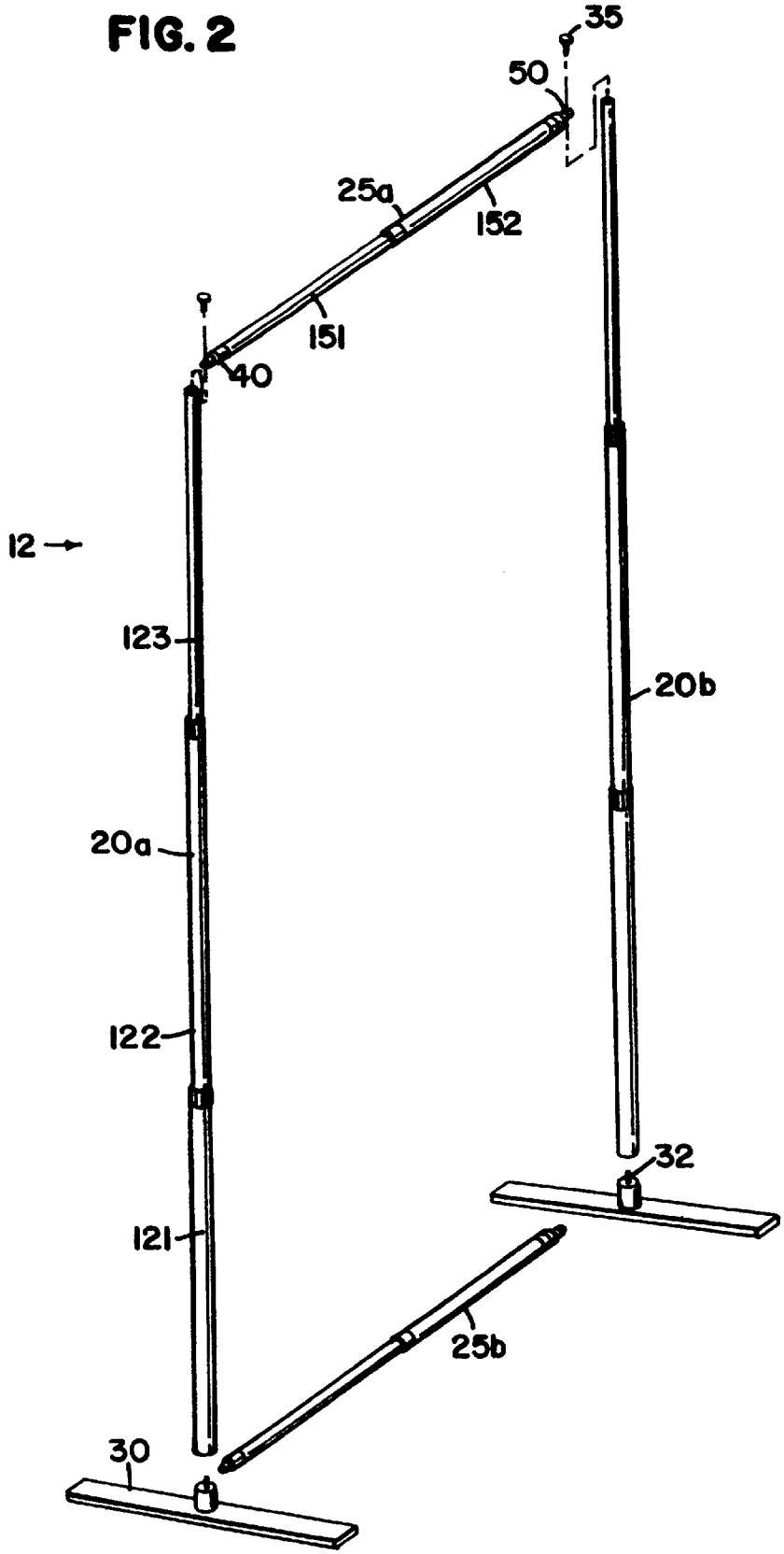
FIG. 2 is an expanded perspective view of the frame of the banner stand of FIG. 1.
Figure 4:
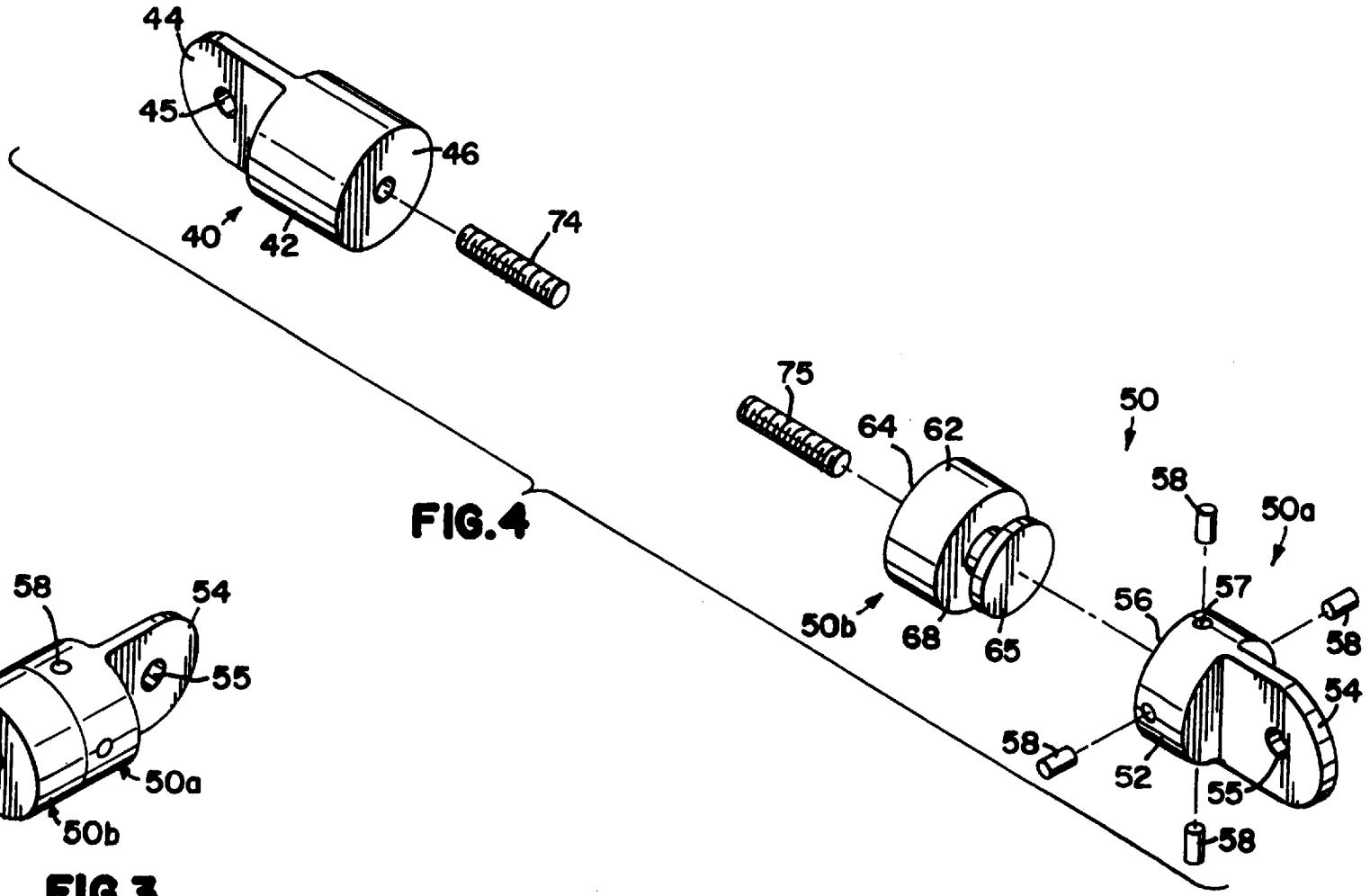
FIG. 4 is an exploded view of the swivel connector of FIG. 3 and of a corresponding non-swivel connector utilized in the banner stand of FIGS. 1 and 2.
Figure 3:
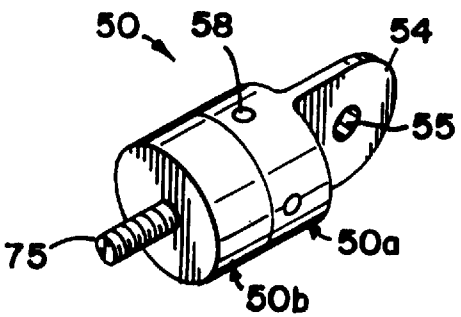
FIG. 3 is a perspective view of a swivel connector utilized in the banner stand of FIGS. 1 and 2.
Figures 5, 6:
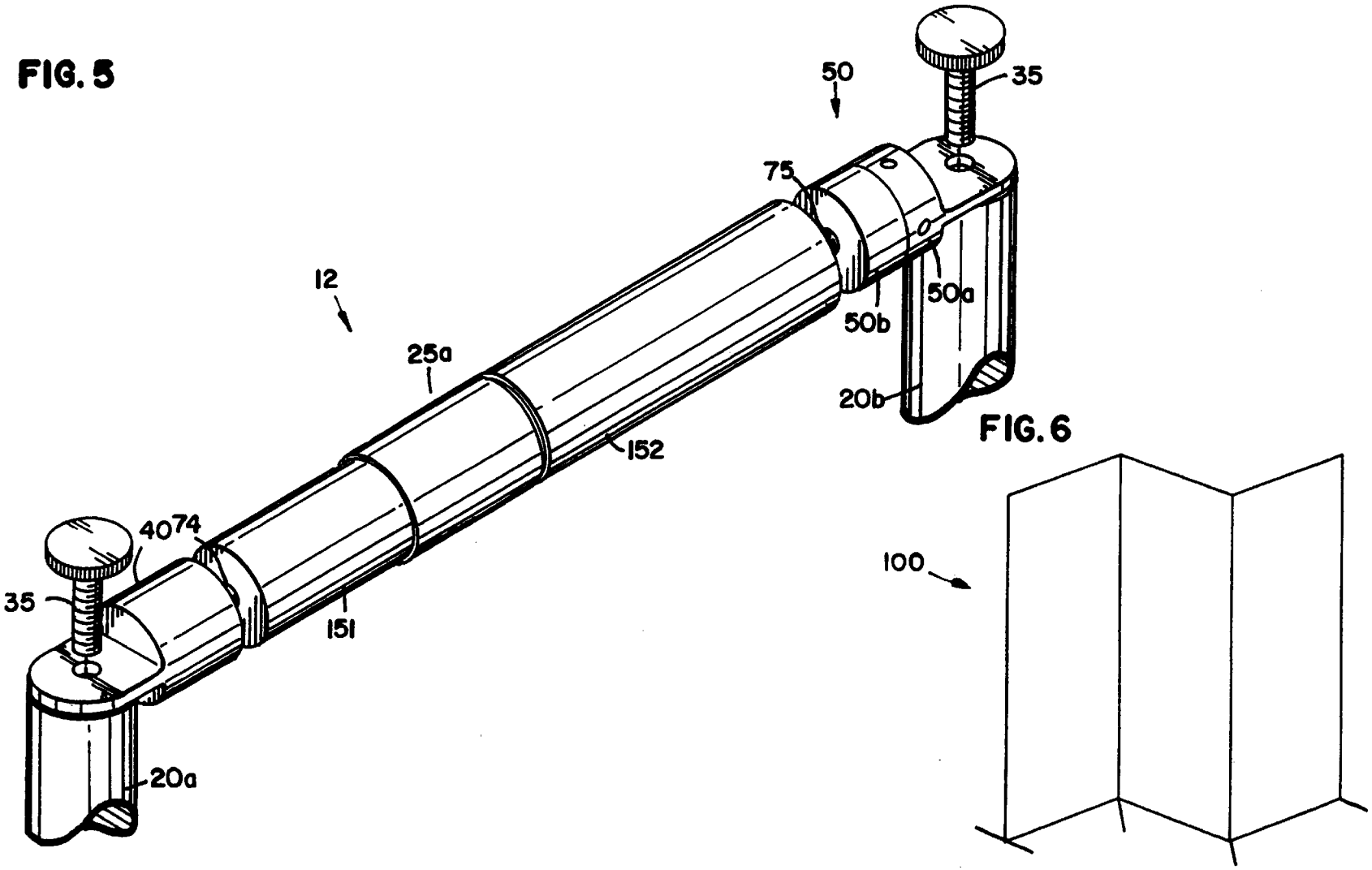
FIG. 5 is an enlarged view of a portion of the frame, showing the swivel connector of FIGS. 3 and 4.
FIG. 6 is a perspective view of a multiple-section banner stand, according to the present disclosure.

Still referring to FIGS. 3 and 4, each connector 40, 50 has an aperture 45, 55, respectively, that engages with a pin, knob, screw, or other fastener to provide a joint at corners 28 of frame 12. The aperture 45, 55 is sized to accept the fastener therethrough. As can be seen in FIGS. 2 and 5, a knob 35 can be passed through the apertures in connectors 40, 50 to attach vertical members 20*a*, 20*b* with horizontal member 25*a*. A pin 32 at the bottom of vertical members 20*a*, 20*b*, in FIG. 2, passed through the apertures, can be used to connect vertical members 20*a*, 20*b* with horizontal member 25*b*. The apertures 45, 55, pin 32 and knob 35 will be discussed in further detail below.

Swivel connector 50 provides easy assembly of banner frame 12. In many situations, the threads on or in the ends of horizontal members 25 are not consistent from one member to another. Similarly, the threads on pin 74 are not consistent from one pin to another. This results in positioning that may be slightly off from where desired. That is, it is very difficult to achieve exact positioning of member. By using a swivel connector 50 on at least one end of horizontal member, compensation is made for the inaccurate positioning caused by the threads. Swivel connector 50 accommodates misalignments that would hinder assembly of frame 12.

Swivel connector 50 is especially useful when banner stand frame 12 is designed with variable length horizontal members 25; that is, horizontal members 25 are telescoping or expandable. Vertical members 20 may also be of variable length. In some embodiments, only vertical members 20 are telescoping and horizontal members 25 are not; and in yet other embodiments, only horizontal members 25 are telescoping and vertical members 20 are not. However, to provide the most flexibility in frame size, preferably all members, vertical members 20 and horizontal members 25, are telescoping.

Telescoping vertical and horizontal members 20, 25 may be incrementally expandable, for example, by having notches, bosses, holes, buttons, or other features that allow pre-set positioning to provide the length of the member. Preferably however, members 20, 25 are expandable to virtually an infinite number of lengths; that is, the length of the member is not limited by pre-determined positions. The telescoping feature of vertical members 20 and horizontal members 25 should be of the type where the poles can be securely locked in the desired length so that the frame does not collapse or otherwise distort during use. Typically, each telescoping or expandable member includes at least a first portion and a second portion; see, for example, FIG. 2 which shows first, second and third portions 121, 122, 123 on vertical member 20*a* and first and second portions 151, 152 on horizontal member 25*a*. These multiple portions are generally axially positioned and sized to allow nesting; that is, one portion is sized to fit inside of and retract into another portion.

Examples of usable telescoping poles include poles of both the internal lock type and the external lock type. Internal locking poles have small outer diameter differences between the first and second portions 151, 152 (as shown in FIG. 2), which is preferably for minimizing wrinkles and other distortions on a banner held by the frame assembled with the poles. External locking poles have larger outer diameter differences between first, second and third portions 121, 122, 123 (as shown in FIG. 2), but typically lock tighter and more securely than internally locking poles. A preferred type of internally locking telescoping pole is a pole having an internal cam-lock; such poles are available from, for example, Testrite Instrument Company, Inc., of Newark, N.J., and J.T.D. Enterprises, Inc. of Troy, Mich. Externally locking telescoping poles are available from, for example, Testrite, and A.P.I.C., Inc. of Emerson, N.J.

Telescoping poles are commercially available in standard sizes, such as a 30 inch pole that can expand up to 55 inches. Although other lengths of expanding poles are available, in some instances it may be preferable to combine one telescoping pole with a fixed length pole to provide a longer telescoping pole. For example, a 30 inch telescoping pole combined with a 30 inch fixed pole will result in a total pole that can range in length from 60 inches to 84–85 inches. A connector 40 or 50 will be used at the ends of the total pole.

In one preferred embodiment of the present invention, telescoping poles having internal locks are used for the horizontal members 25 and telescoping poles having external locks 22 are used for the vertical members 20. In another preferred embodiment of the present invention, a swivel connector 50 is disposed on one end of a telescoping horizontal member 25 and a non-swivel connector 40 is disposed on the opposite end of the horizontal member 25. This configuration (i.e., one swivel connector 50 on each telescoping member 25), will be used for discussion for the remainder of this disclosure.

A common problem in assembling frame 12 often occurs when telescoping poles are used if only non-swivel connectors, such as non-swivel connectors 40, are used.

Many telescoping poles function by allowing rotation of at least one of the member portions (e.g., portion 151 or 152). The result is that the outer surface of one portion 151 will change in respect to another portion 152. Thus, if the ends of horizontal member 25 were accurately positioned for attachment to vertical members 20 prior to telescoping horizontal member 25, the ends may not be positioned the same after expansion of the member and thus, no longer affording correct alignment for attachment.

To accommodate and compensate for unpredictable positioning of the ends of horizontal members 25, at least one swivel connector 50 is disposed on each horizontal member 25. A swivel connectors 50 may be used at each end of the horizontal member 25, to provide a horizontal member 25 with two swivel connectors. In FIGS. 2 and 5, a swivel connector 50 is disposed on one end of horizontal member 25*a*.

Referring now to the details shown in FIGS. 2, 3 and 5, and particularly FIG. 4, swivel connector 50 has two parts, a female portion 50*a* and a male portion 50*b*. The engagement of male portion 50*b* with female portion 50*a* allows swivel connector 50 to circumferentially rotate about an axis that runs longitudinally through male portion 50*b* and female portion 50*a* when the two are engaged, and through member, such as horizontal member 25, onto which swivel connector 50 is disposed. Female portion 50*a* and male portion 50*b* are fully rotatable with respect to one another; that is, there is no limit on the number of degrees of rotation.

Female portion 50*a* includes cylindrical body 52 having a base 56 and, at a distal end opposite base 56, a tab 54 having an aperture 55 passing therethrough. Tab 54 and aperture 55 are sized to facilitate engagement of swivel connector 50 to vertical member 20*b*, as shown in FIG. 5. Tab 54 preferably has a flat structure, to allow stacking of multiple connectors 50 through a single pin 32 or knob 35. Base 56 of female portion 50*a* includes a recess (not shown) adapted for acceptance of at least a portion of male portion 50*b*. Male portion 50*b* includes cylindrical body 62 having a base 64 and the protrusion 65 on the end opposite base 64. Protrusion 65 is sized to engage with recess on base 56 of female portion 50*a*. Protrusion 65 together with circumferential groove 68 provide for rotation of male portion 50*b* within female portion 50*a*. The axis of rotation of male portion 50*b* within female portion 50*a* is co-linear with the longitudinal axis of swivel connector 50 and horizontal member 25, when swivel connector 50 is mounted on horizontal member 25. Male portion 50*b* is held into female portion 50*a* by pins 58 with pass through holes 57 in cylindrical body 52. Pins 58 extend through cylindrical body 62 and engage with groove 68, thereby allowing rotation of male portion 50*b* in relation to female portion 50*a*.

Swivel connector 50 includes an externally threaded pin 75 in base 64 that is adapted to dispose swivel connector 50 with horizontal member 25. This threaded pin 75 may be permanently affixed to swivel connector 50 or may be removable and replaceable. Alternately, pin 75 may be permanently affixed to horizontal member 25 and engage with an internal thread within base 64. Once disposed, base 64 of swivel connector 50 should not move in relation to horizontal member 25; that is, swivel connector 50 should not swivel or otherwise rotate around pin 75 or other feature of connector 50.

In a preferred embodiment, swivel connector 50 has an overall length (measured from base 64 to the end of tab 54), of greater than about 1 inch, less than about 4 inches, typically about 1.5 inches to 2 inches. The width of swivel connector 50, is preferably similar to the width or diameter of the horizontal member 25 on which it is disposed. Typically the width of swivel connector is greater than about 0.5 inch, less than about 2 inches, and typically is about 1 inch. Cylindrical body 52 of female portion 50*a* and cylindrical body 62 of male portion 50*b* may be similar in length, for example, about 0.5 inch. Tab 54 may be any size that allows to provide an aperture 55 therethrough, for example, about 1 inch. In one preferred embodiment, the surface area of tab 54 is similar to the cross sectional area of horizontal member 25; that is, a portion, and preferably a majority, of tab 54 is circular. Such a configuration facilitates producing a banner frame 200 illustrated in FIG. 6, which will be discussed later in detail.

Disposed at the other end of horizontal member 25 in FIGS. 2 and 5 is a non-swivel connector 40. Non-swivel connector 40 has a cylindrical body 42 with a base 46 which is constructed to abut and contact the horizontal member 25 on which non-swivel connector 40 is disposed. Opposite base 46, non-swivel connector 40 has a distal end with tab 44. Tab 44 includes an aperture 45 therethrough to allow attachment to vertical member 20. Tab 44 and aperture 45 are sized to facilitate engagement of non-swivel connector 40 to vertical member 20*a*, as shown in FIG. 5. In one preferred embodiment, the surface area of tab 44 is similar to the cross sectional area of horizontal member 25*a*; that is, a portion, and preferably a majority, of tab 44 is circular.

Non-swivel connector 40 includes a threaded pin 74 in base 46 that is adapted to dispose non-swivel connector 40 onto horizontal member 25. This threaded pin 74 may be permanently affixed to non-swivel connector 40 or may be removable and replaceable. Alternately, pin 74 may be permanently affixed to horizontal member 25. Base 46 of non-swivel connector 40 should not move in relation to horizontal member 25; that is, non-swivel connector 40 should not swivel or otherwise rotate around pin 74 or other feature of connector 40.

In a preferred embodiment, non-swivel connector 40 is shaped and sized similar to swivel connector 50. Non-swivel connector 40 has an overall length (measured from base 46 to the end of tab 44), of greater than about 1 inch, less than about 4 inches, typically about 1.5 inches to 2 inches. The width of non-swivel connector 40 is preferably similar to the width of swivel connector 50 and to horizontal member 25. Cylindrical body 42 is generally about 0.5 to 1 inch in length. Tab 44 may be any size that allows to provide an aperture 45 therethrough, for example, about 1 inch. In one preferred embodiment, the surface area of tab 44 is similar to the cross sectional area of horizontal member 25; that is, a portion, and preferably a majority, of tab 44 is circular.

Additional features of frame 12 include base 30 and a pin, projection, or other feature to allow securement of vertical member 20 to base 30. FIG. 2 shows base 30 with a pin 32, which is configured to engage with vertical member 20 and with the connector 40 or 50 on lower horizontal member 25*b*. As shown in the Figures, pins 32 are constructed and arranged to extend from base 30 into a recess in vertical member 20. In some embodiments, it may be desired that pins are fixed to and extend from vertical member 20 into a recess in base member 30. Pins 32 may be permanently attached to one of base 30 and vertical member 20, or neither. Vertical member 20 can be attached to base member 30 by joining pin 32, such as a threaded pin, with a threaded recess, a square pin and a square recess, or any polygonal shaped pin and recess. It is not necessary that pin 32 and the recess have the same shape; in fact, different shapes of pin 32 and the recess may be preferred for some designs. In some embodiments, it may be desired to have a quick-release system, such as one using a ball and detent.

To attach bottom horizontal member 25*b* to vertical members 20 and base members 30, aperture 45 in tab 44 of non-swivel connector 40 and aperture 55 in tab 54 of swivel connector 50 are aligned with pins 32, so that pins 32 extend through apertures 45, 55. As discussed above, the connector on at least one end of horizontal member 25*b* is a swivel connector 50; the connector of the other end may be a swivel connector 50 or a non-swivel connector 40.

To attach top horizontal member 25*a* to vertical members 20, aperture 45 in tab 44 of non-swivel connector 40 and aperture 55 in tab 54 of swivel connector 50 are aligned with knobs 35, so that knobs 35 extend through apertures 45, 55. Knobs 35 may be any knob, pin, post or that like that extends from vertical member 20; this knob, pin, post, etc., may be permanently fixed within vertical member 20 or may be removable. Similar to the bottom horizontal member 25*b* discussed above, the connector on at least one end of top horizontal member 25*a* is a swivel connector 50; the connector of the other end may be a swivel connector 50 or a non-swivel connector 40.

A preferred banner stand frame 15, in accordance with the present disclosure, consists of four members, two horizontal members and two vertical members; four connectors to secure the four members to each other at their ends, preferably two swivel connectors 50 and two non-swivel connectors 40; hardware to attach the connectors to the members; and a base to stabilize the banner stand. In one embodiment, two of the members are telescoping members. In another embodiment, all four members are telescoping members. And in yet another embodiment, the two horizontal members are telescoping members with internal lock mechanisms and the two vertical members are telescoping members with external lock mechanisms.

The banner stands according to the present disclosure may be single panel stands, such as illustrated in FIG. 1, or may be multiple panel stands, such as stand 100 illustrated in FIG. 6. With connectors 40, 50, multiple panel stands, with or without telescoping members, can easily be assembled. A flat tab 44, 54 on connector 40, 50 allows for easy stacking of multiple tabs on the same fastener, such as pin 32 or knob 35. If the width of tab 44, 54 is sized similar to the diameter of the horizontal member on which it is disposed, two (or more) stacked connectors 40, 50 can easily swivel in relation to the fastener and allow for various angle configurations.

Swivel connector 50, and also non-swivel connector 40, may be formed from any material that will be sufficient to withstand the forces upon it during use. The connectors may be made from metal, plastic, wood, ceramic, or other materials. A plastic connector may be molded, cast, machined, or made otherwise. Similarly, a metal connector may be molded, cast, machined, or made otherwise. The swivel connector 50 of the present disclosure is a simple, non-complicated design that utilizes a minimal number of parts.

One method of how to assemble a banner stand 10, in particular a banner stand frame 12, will now be described in relation to FIGS. 2 and 5. Preferably, the banner stand frame 12 has four telescoping members with a swivel connector on at least one end of each member that will be a horizontal member 25. A non-swivel connector 40 is on any end of horizontal member 25 with no swivel connector. For the two telescoping members that will be vertical members 20, one end of each member has a protruding externally threaded pin 35, and the other end of each member has a recess to accept pin 32 of base 30.

First, vertical members 20 and horizontal members 25 are extended to their desired length. The lower horizontal member 25*b* is placed so that pins 32 of base 30 pass through aperture 45 in non-swivel connector 40 and through aperture 55 in swivel connector 50. Typically, aperture 45 is first engaged with pin 32 of one base and then aperture 55 is engaged with pin 32 of the other base. The rotating feature of swivel connector 50 allows aperture 55 to be aligned so as to engage with pin 32 no matter what length horizontal member 25*b* is. Vertical members 20*a*, 20*b* are then placed so that the recess in the end of vertical members 20 align and join with pins 32 of base 30. Top horizontal member 25*a* is positioned over vertical members 20 and apertures 45, 55 of connectors 40, 50 are aligned with and passed through pins 35. Any advertisement banner 15 (FIG. 1) may then be attached to frame 12.

It is understood that this is only one example of a method to assemble a banner stand frame, and that variations, for example, in the order of steps, the positioning of pins, connectors, and the like, are acknowledged. For example, horizontal members 25 may be slid into loops 16 or an elongate sleeve on advertisement 15 prior to assembling frame 12.

The present disclosure also includes a method of displaying a banner or advertisement sign on a stand or frame. Typically, a fabric, plastic, paper, or other flexible sheet is suspended and displayed by banner stand frame 12. The advertisement banner or sign (shown as 15 in FIG. 1), is generally attached to one or more horizontal members 25, one or more vertical members 20, or all members. Sign 15 is typically attached by passing a member through a loop 16 in sign 15; the loops may be permanently formed, such as by stitching, gluing, etc., or may be openable and recloseable, such as by snaps, or hook and loop attachment systems. A loop may extend the entire width or length of sign 15 or may be a narrow loop.

The above specification, examples and data provide a complete description of the manufacture and use of the invention. Many embodiments of the invention can be made.

We claim:

1. A standing frame for supporting an advertisement banner, the frame comprising:

a pair of first members, each first member having a first end and a second end;

a pair of second members, each second member having a first end and a second end;

at least two swivel connectors configured for connecting the pair of first members with the pair of second members; the swivel connectors disposed to the first end of each of the pair of first members, each swivel connector further removably attached to one of the pair of second members; the swivel connectors each comprising:

a male portion comprising a body with a groove therein and a base;

a female portion comprising a body and a base, the female base having a recess, the recess constructed and arranged to accept at least a portion of the male portion therein, to allow rotation of the male portion in relation to the female portion about a longitudinal axis; one of the male portion and the female portion having a tab opposite the base, the tab having an aperture therethrough.

2. The frame according to claim 1, wherein each of the pair of first members is a telescoping member.

3. The frame according to claim 2, wherein each of the pair of second members is a telescoping member.

4. The frame according to claim 1, comprising four swivel connectors, the swivel connectors attached to each end of the pair of first members.

5. The frame according to claim 1, wherein the female portion of the at least two swivel connectors further comprises a pin in the female body extending into the groove in the male portion.

6. The frame according to claim 5, further comprising a plurality of pins in the female body extending into the groove in the male portion.

7. The frame according to claim 1, wherein the groove on the male portion is between the male body and a protrusion, the protrusion constructed and arranged to fit within the recess in the female base.

8. The frame according to claim 1, wherein the male portion and the female portion are cylindrical about the longitudinal axis.

9. The frame according to claim 1, wherein the female portion of each swivel connector comprises the tab having the aperture therethrough.

10. The frame according to claim 1, wherein at least one of the pair of second members is removably attached to the swivel connector by a fastener, which is inset within the at least one of the pair of second members and is constructed and arranged to pass through the aperture.

11. A frame for displaying an advertisement banner, the frame constructed to be located on a supporting surface, the frame comprising:

(a) a first horizontal member having a first end and a second end, the first end having a first swivel connector attached thereto about a longitudinal axis, the first horizontal member extending generally approximately parallel to the supporting surface;

(b) a second horizontal member having a first end and a second end, the first end having a second swivel connector attached thereto about a longitudinal axis, the second horizontal member extending generally approximately parallel to the supporting surface;

(c) a first vertical member, extending generally about 90 degrees from the supporting surface;

(d) a second vertical member, extending generally about 90 degrees from the supporting surface;

wherein the first and second swivel connectors each comprise:

a male portion comprising a body with a groove therein and a base,;

a female portion comprising a body and a base, the female base having a recess, the recess constructed and arranged to accept at least a portion of the male portion therein about the longitudinal axis, to allow rotation of the male portion in relation to the female portion about the longitudinal axis; one of the male portion and the female portion having a tab opposite the base, the tab having an aperture therethrough.

12. The frame according to claim 11, wherein the male portion and the female portion are cylindrical along the longitudinal axis formed by the first and second horizontal members.

13. The frame according to claim 11, wherein the first and second vertical members each have a first end and a second end, each of the first and second ends constructed and arranged to accept a fastener therein.

14. The frame according to claim 11, further comprising a base constructed and arranged for attachment to said first and second vertical members.

15. The frame according to claim 11, wherein the first and second horizontal members are telescoping members.

16. The frame according to claim 11, wherein the first and second vertical members are telescoping members.

17. The frame according to claim 16, wherein the first and second vertical telescoping members have an external lock mechanism.

18. A standing frame for supporting an advertisement banner, the frame comprising:

(a) a first telescoping member and a second telescoping member, each of the first and second members:

(i) extending generally approximately parallel to the supporting surface; and (ii) having a first end and a second end, the first end having a swivel connector attached thereto along a longitudinal axis;

(b) a third telescoping member and a fourth telescoping member, each of the third and fourth members:

(i) extending generally perpendicular to the supporting surface;

(ii) having an external lock mechanism;

wherein the first and second swivel connectors each comprise:

(c) a male portion comprising a body with a groove therein and a base;

(d) a female portion comprising a body and a base, the female base having a recess, the recess constructed and arranged to accept at least a portion of the male portion therein along the longitudinal axis, to allow rotation of the male portion in relation to the female portion about the longitudinal axis;

(e) one of the male portion and the female portion having a tab opposite the base, the tab having an aperture therethrough.

* * * * *